US009332837B2

(12) United States Patent
Pencak

(10) Patent No.: US 9,332,837 B2
(45) Date of Patent: May 10, 2016

(54) APPARATUS FOR HOLDING AND DISPLAYING ARTICLES

(71) Applicant: W.W. GRAINGER, INC., Lake Forest, IL (US)

(72) Inventor: Thomas Edward Pencak, Franksville, WI (US)

(73) Assignee: W.W. GRAINGER, INC., Lake Forest, IL (US)

( * ) Notice: Subject to any disclaimer, the term of this patent is extended or adjusted under 35 U.S.C. 154(b) by 91 days.

(21) Appl. No.: 13/731,602

(22) Filed: Dec. 31, 2012

(65) Prior Publication Data

US 2014/0183324 A1 Jul. 3, 2014

(51) Int. Cl.

| | |
|---|---|
| ***A47G 1/24*** | (2006.01) |
| ***A47B 23/04*** | (2006.01) |
| ***A47F 7/14*** | (2006.01) |

(52) U.S. Cl.

CPC ..... *A47B 23/043* (2013.01); *A47F 7/142* (2013.01); *Y10T 29/49826* (2015.01)

(58) Field of Classification Search

CPC ..... F16M 11/20; F16M 2200/08
USPC ..... 248/47, 448, 451, 455, 456, 354.5, 248/163.1, 166, 167, 188.8, 188.9, 188.91, 248/346.03, 1, 88.9, 188.914, 441.1
See application file for complete search history.

(56) References Cited

U.S. PATENT DOCUMENTS

| | | | | |
|---|---|---|---|---|
| 2,419,721 | A * | 4/1947 | Kopp | 248/456 |
| 2,872,252 | A * | 2/1959 | Konkle | 182/131 |
| 3,034,754 | A * | 5/1962 | Trindl | 248/158 |
| 3,635,351 | A * | 1/1972 | Homs | 248/447 |
| 4,561,623 | A * | 12/1985 | Shepherd et al. | 248/447 |
| 5,248,030 | A * | 9/1993 | Tarozzi | 206/1.7 |
| 6,206,426 | B1 * | 3/2001 | Azzato | 281/45 |
| 6,679,468 | B1 * | 1/2004 | Hsu | 248/454 |
| 6,776,385 | B1 * | 8/2004 | Chang | 248/448 |
| 7,770,864 | B2 * | 8/2010 | Phifer et al. | 248/455 |
| 8,608,257 | B2 * | 12/2013 | Li et al. | 312/10.1 |
| 2008/0093523 | A1 * | 4/2008 | Dumas | 248/447 |
| 2008/0135713 | A1 * | 6/2008 | Santoro | 248/346.03 |
| 2011/0073740 | A1 * | 3/2011 | Leduc | 248/451 |

* cited by examiner

*Primary Examiner* — Joanne Silbermann
(74) *Attorney, Agent, or Firm* — Greenberg Traurig, LLP

(57) ABSTRACT

An assembly for holding and displaying books, or items having a book-like structure includes a book attached to a hinged book-holding device, which displays the book in various positions. The hinge allows the book to move in at least two positions, a first standing position and a second, inclined position. The disclosed book-holding system also comprises a stabilizing mechanism that, when activated, provides a broader structural base. Thus, when the book is inclined and opened, the stabilizing mechanism holds the entire system steady so it does not tilt open.

12 Claims, 12 Drawing Sheets

APPARATUS FOR HOLDING AND DISPLAYING ARTICLES

FIELD OF THE DISCLOSURE

The present disclosure generally relates to an apparatus for holding and displaying articles, including books, and more specifically, to an adjustable, hinged apparatus that displays articles in various positions, including a standing, closed position, and an inclined open position.

BACKGROUND

The present disclosure generally relates to an assembly for displaying articles such as books, catalogs, manuals, or items having a book-like structure, in various positions. Books such as ordering catalogs, that are used often are sometimes easily damaged, and may become worn quickly, especially if the books are large and voluminous. Moreover, large books are often unwieldy, difficult to manipulate, and/or difficult to share with others. For example, to share a particular passage of a book with a second user standing in a different position the first user must manually lift, slide, and/or rotate the book. Additionally, large and unwieldy books are often displayed and used on a flat surface, such as a table or a counter. However this angle may cause neck strain for users, and may increase the wear on the book cover and binding.

The present disclosure provides a structure for displaying books in open, inclined positions. The present disclosure provides ease and flexibility to the user by making it simple to manipulate and share a book. The disclosed structure may also protect the book, increasing its shelf-life. Additionally the structure provides an attractive means of displaying a book in an open or closed position, which is suitable for decorative and/or promotional purposes.

BRIEF DESCRIPTION OF THE DRAWINGS

For a better understanding of the present disclosure, reference may be had to various examples shown in the attached drawings.

DETAILED DESCRIPTION

Figure 1:
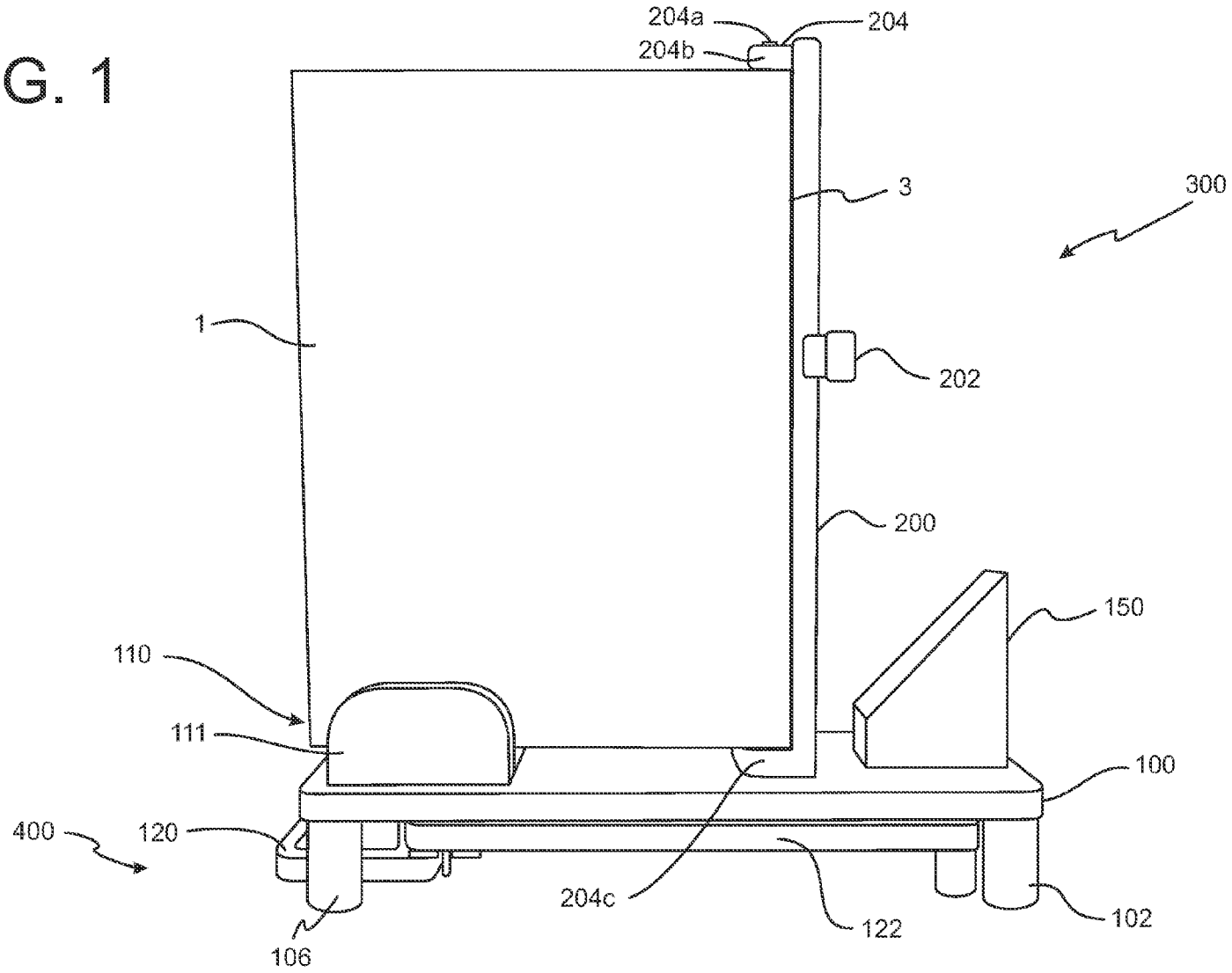
FIG. 1 is a front view of the book-holding system in a standing, closed position.

Generally, the present disclosure relates to an apparatus for holding and displaying a book, catalog, manual, directory, or other similar items having a book-like structure. While in the present disclosure, the term "book" is often used to describe such objects, it will be appreciated by one of ordinary skill in the art that the described "book" may be any suitable article. For example, in the present disclosure, a book is attached to a hinged book-holding device, which displays the book in various positions. In particular, the hinge allows the book to move in at least two positions, a first standing position so the book is vertical and a second, inclined position so the book is tilted. The disclosed book-holding system also comprises a stabilizing mechanism that, when activated, provides a broader structural base. Thus, when the book is inclined and opened, the stabilizing mechanism holds the entire system steady so it does not tilt open.

The following description of example system and apparatus is not intended to limit the scope of the description to the precise form or forms detailed herein. Instead the following description is intended to be illustrative so that others may follow its teachings.

Referring now to the figures, an example book-holding apparatus 300 is generally described with reference to FIGS. 1-11. Specifically, FIGS. 1-4 depict the apparatus 300 holding an example book 1 in a closed, upright position. As will be appreciated by one of ordinary skill in the art, the book 1 may be a hardcover book, softcover book, textbook, reference book, catalog, telephone books, album, CD-catalog, and/or any other appropriate object having a structure resembling a book. As shown, the book-holding apparatus 300 comprises a base 100, with base feet 102, 104, 106, 108, which together create a stable foundation for the book 1.

In this example, the book 1 is attached to the base 100 via a spine element 200, which is in-turn coupled to the base 100 by a hinge 206. The example spine element 200 attaches to the book 1 via a mating element 204, such as for example, at least one rod 204*a* extending between an upper flange 204*b* and a lower flange 204*c*, through the pages and/or spine of the book. As will be appreciated by one of ordinary skill in the art, the mating element 204 may use various mechanical means to attach to the book 1, including, for example, a clamping mechanism, screw, friction fit, magnetic attachment, adhesive, hook-and-loop fastener, snap-on feature, quick-release assembly, and/or any other appropriate attachment means.

Still further, in the illustrated example, the spine element 200 attaches to the book 1 at a spine portion 3 of the book 1. However, one of ordinary skill in the art will recognize that the spine element 200 may also attach to a book 1 by the cover, base, and/or any other appropriate location on the book 1. Additionally, in still further example, the apparatus 300 may provide a permanent, semi-permanent, rigid or semi-rigid cover that attaches to the book 1.

The example spine element 200 further includes a blocking element 202 that extends horizontally from both sides of the spine element 200, which, in this instance, restricts the angle that the book 1 can open to. In the illustrated example, the blocking element 202 is straight so the book 1 can open to a maximum angle of 180°. However, one of ordinary skill in the art will recognize that the blocking element 202 may be angled so that the book 1 may open to a maximum angle that is greater than or less than 180°. Still further, it will be appreciated that the blocking element 202 may be any suitable structure to prevent and/or permit the book 1 to open a certain distance, and the element 202 may be integrally and/or separately formed with the spine element 200 as desired.

As shown in FIGS. 1-4, the example hinge 206 connects the spine element 200 to the base 100. In this illustrated example, the hinge 206 is a piano hinge, but one of ordinary skill in the art will recognize that the hinge 206 may be any suitable rotatable hinge-like structure, and/or any other appropriate rotating mechanism. In this example, the hinge 206 allows the book 1 to incline so that the book 1 may be move between an upright position and an inclined position, as defined by a backstop 150. Specifically, when the book 1 is upright, the hinge 206 is disposed at a 90° angle relative to the base 100. When the book 1 is inclined, however, the spine element 200 may rest upon the backstop 150 such that the hinge 206 is disposed at an angle relative to the base 100. In this instance the inclined angle corresponds to the angle of the backstop 150, but it will be understood that the angle may be any suitable angle, i.e., the entirety of the backstop 150 does not necessarily contact the spine element 200. In the illustrated example, the backstop 150 is static in both height and position relative to the base 100, so the book-holding apparatus 300 provides two vertical position stops for the book 1: a first upright position (shown in FIGS. 1-4), and second inclined position (shown in FIGS. 5-7). However, one of ordinary skill in the art will recognize that the backstop 150 may be variable in heights and/or position so that the book 1 may incline at numerous, stable position stops. For example, the apparatus 300 may provide various, interchangeable backstops 150, and/or the backstop 150 may be adjustable, e.g., via a ratchet system, lever system, and/or any other appropriate system.

Figure 2:
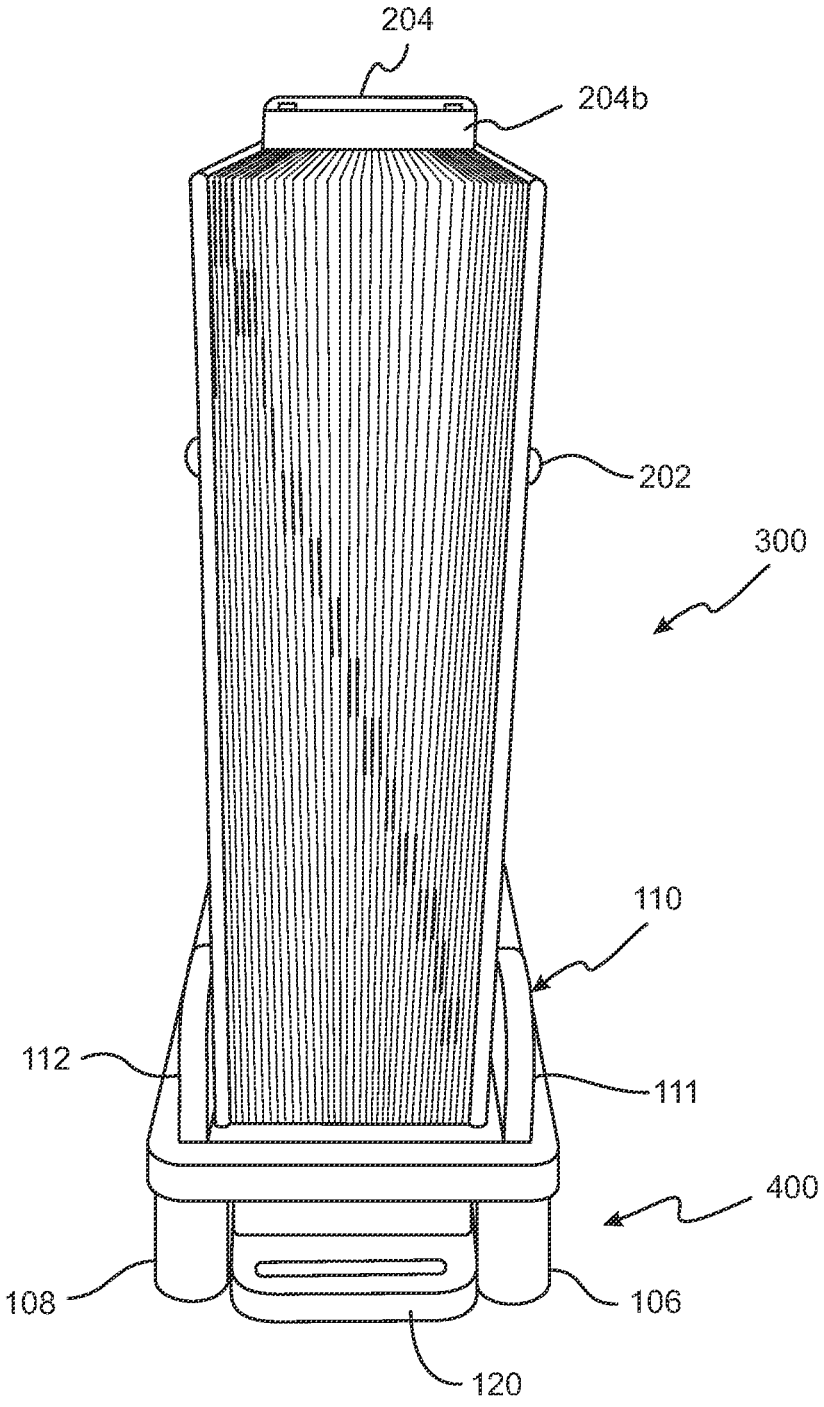
FIG. 2 is a side view of the book-holding system in a standing, closed position.
Figure 3:
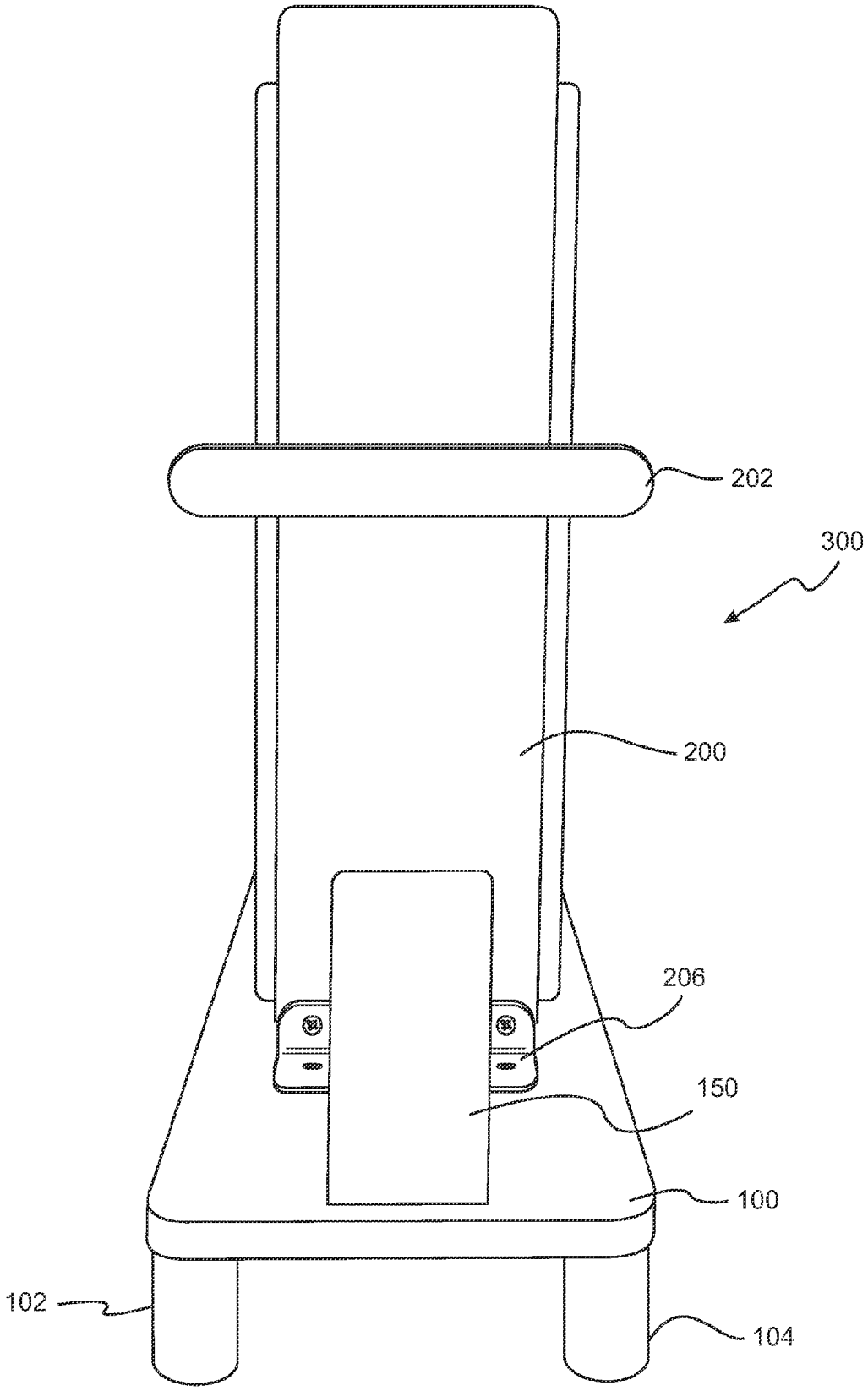
FIG. 3 is a side view of the book-holding system in a standing, closed position.
Figure 4:
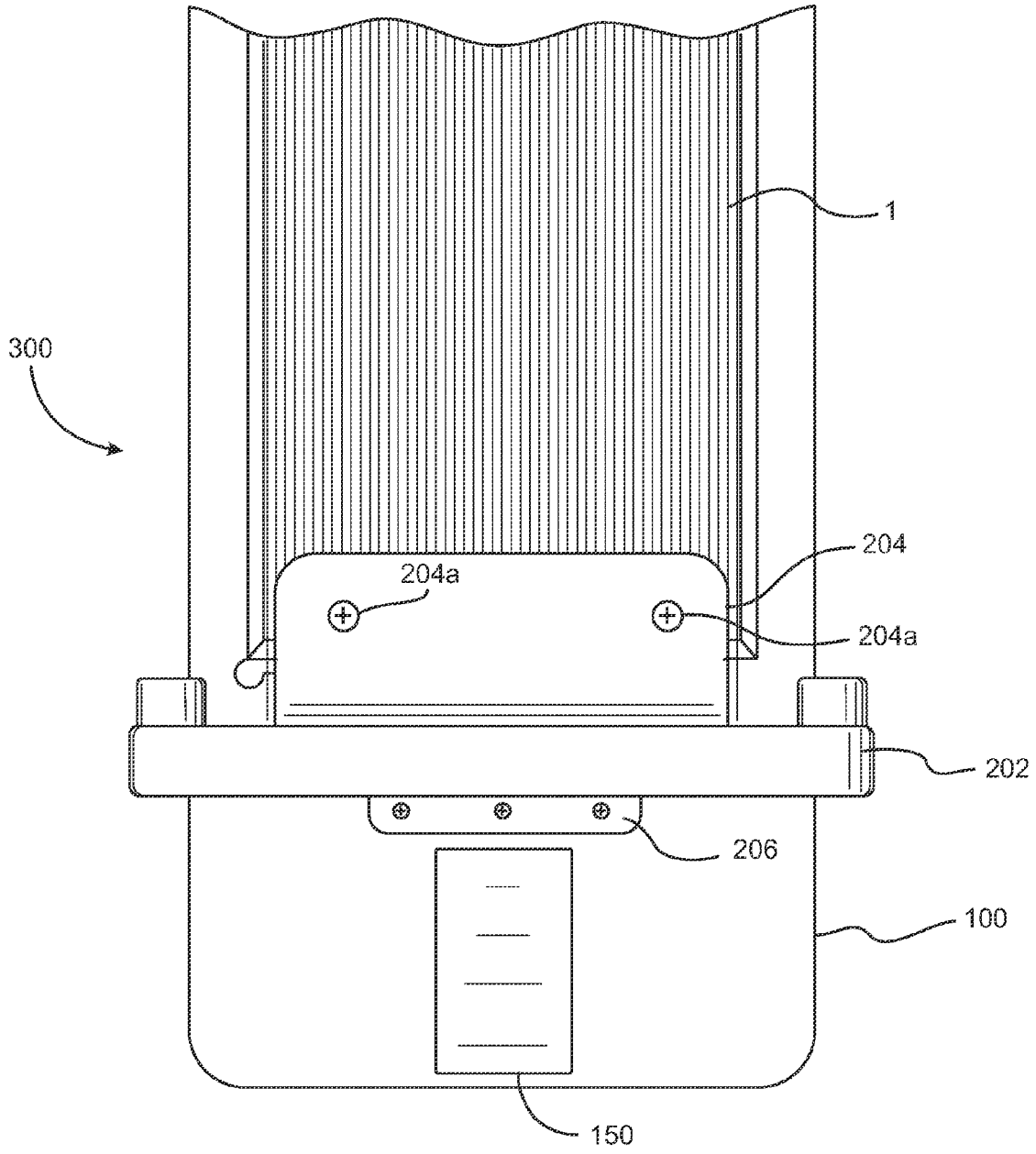
FIG. 4 is a top view of the book-holding system in a standing, closed position.

As shown in the illustrated example, when the book 1 is upright, it may be held closed via a clamp 110, comprised of clamping elements 111, 112, which are attached to the base 100. As will be appreciated, the clamping elements 110 cooperate to hold the book 1 in a closed position, such as illustrated in FIG. 2. As with the backstop 150, in the illustrated example, the clamp 110 is statically mounted to the base 100. However, one of ordinary skill in the art will understand that the clamp 110 may be an adjustable mechanism that allows for varying positions, sizes, etc. as desired. For example, the clamping elements 111, 112 may be constructed so as to pop-up, fold down, be made of flexible material, etc.

Figure 5:
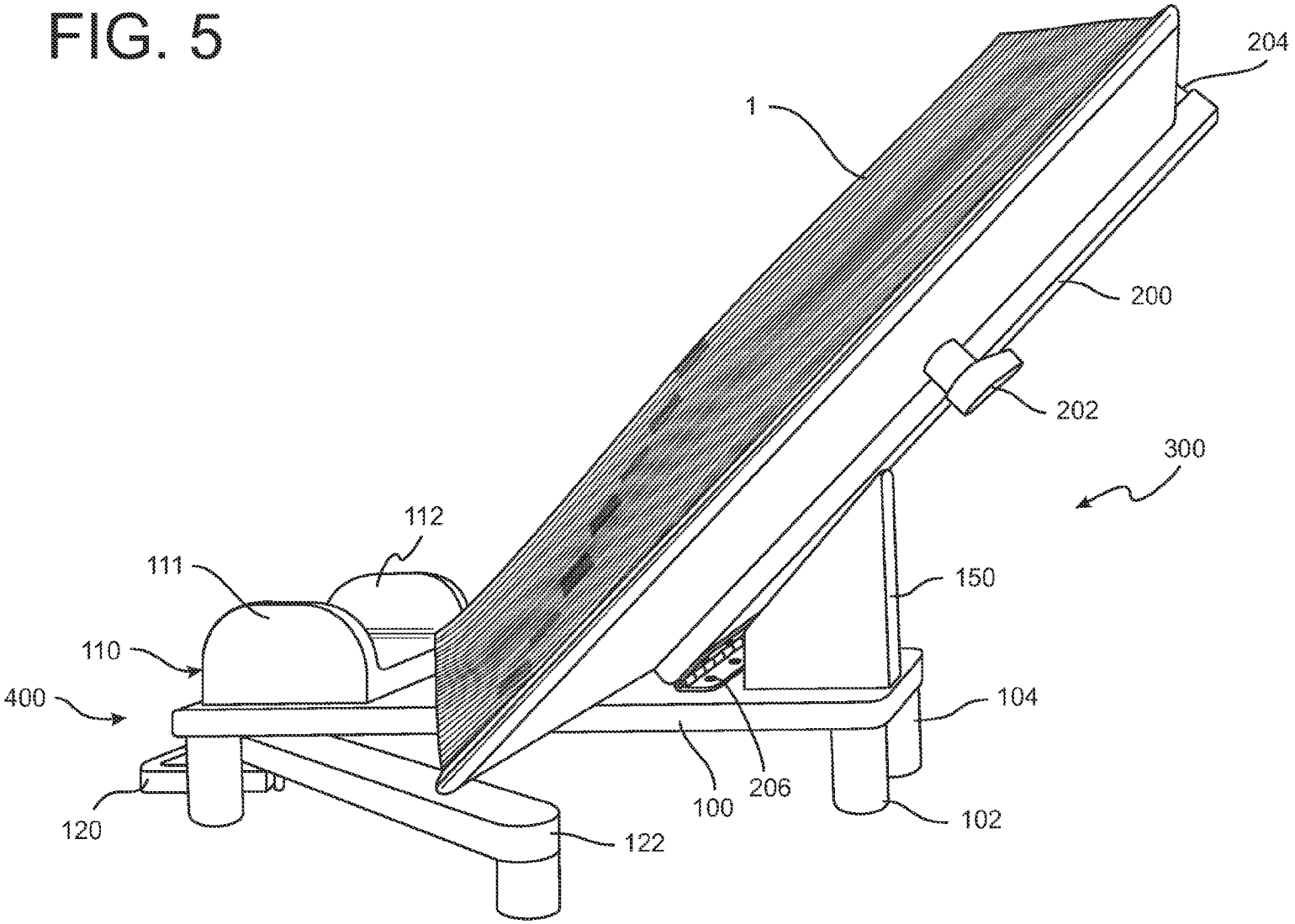
FIG. 5 is a front view of the book-holding system in an angled, open position.
Figure 6:
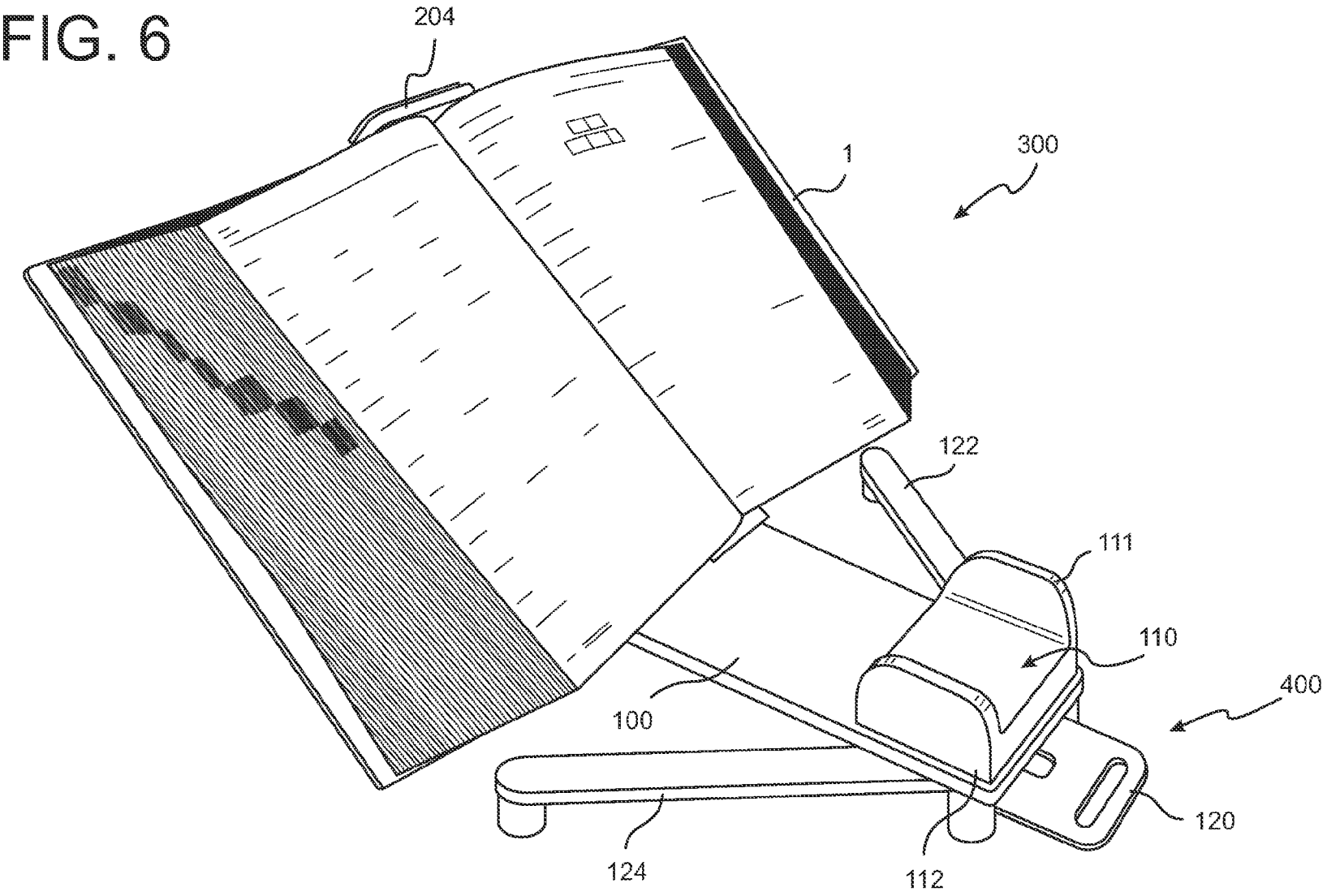
FIG. 6 is a perspective view of the book-holding system in an angled, open position.
Figure 7:
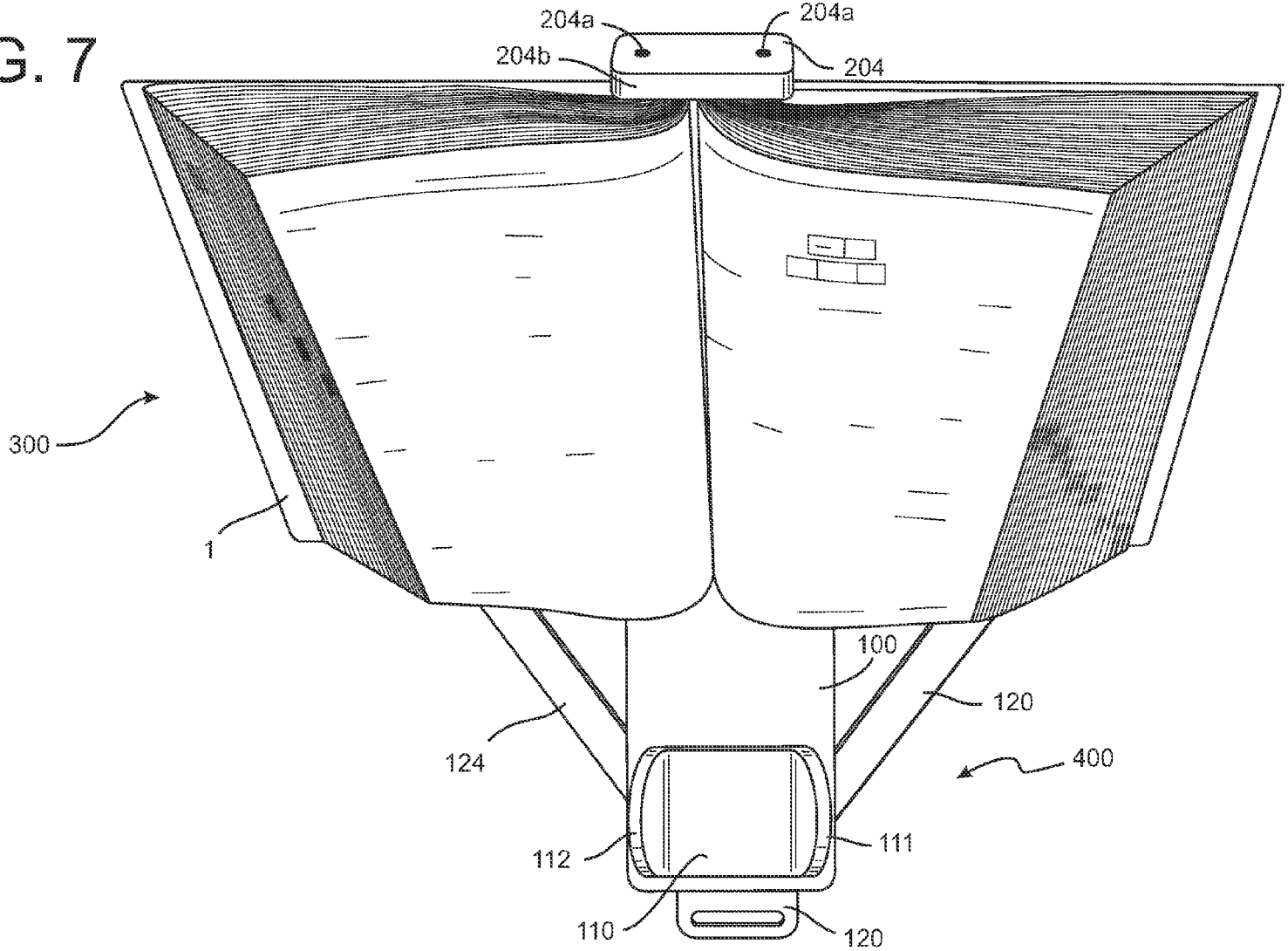
FIG. 7 is a top view of the book-holding system in an angled, open position.

Referring now to FIGS. 5-7, the example book-holding apparatus 300 is shown in another position wherein the book 1 is inclined so that the spine element 200 rests upon the backstop 150. In this inclined position, the book 1 may be closed, or open (as shown in FIGS. 5-7) so that the covers of the book 1 rest upon the blocking element 202.

It will be appreciated that inclining and/or opening the book 1 typically causes the system's 300 weight and/or center of gravity to be redistributed, and thus the apparatus 300 may be provided with a stabilizing assembly 400 to compensate for such redistribution where necessary. In this example, the stabilizing assembly is comprised of a stabilizing trigger 120, and two stabilizing legs 122, 124, which extend as necessary and/or desired. In particular, in this example, the stabilizing assembly 400 may be manually deployed to compensate for any destabilization of the base 100. In particular, the stabilizing trigger 120 may be manually activated by pulling it outward, such as for example in a direction parallel to the base 100, and away from the center of the base 100. However, one of ordinary skill in the art will recognize that the stabilizing trigger 120 may be activated by any suitable means including, for instance, by button, switch, slide, lever, remote control, and/or any other appropriate triggering mechanism. In the illustrated mechanism, the stabilizing trigger 120 causes two stabilizing legs 122 and 124 to extend outward from the base 100 at an oblique angle, to extend the base 100 and to keep the apparatus 300 steady by distributing weight across a larger base area. As will be understood by one of ordinary skill in the art, the stabilizing legs 122, 124 may be of various shapes, for example, they may be rectangular, oval, wire-framed, circular, straight, bent, or any other appropriate shape.

Figure 8:
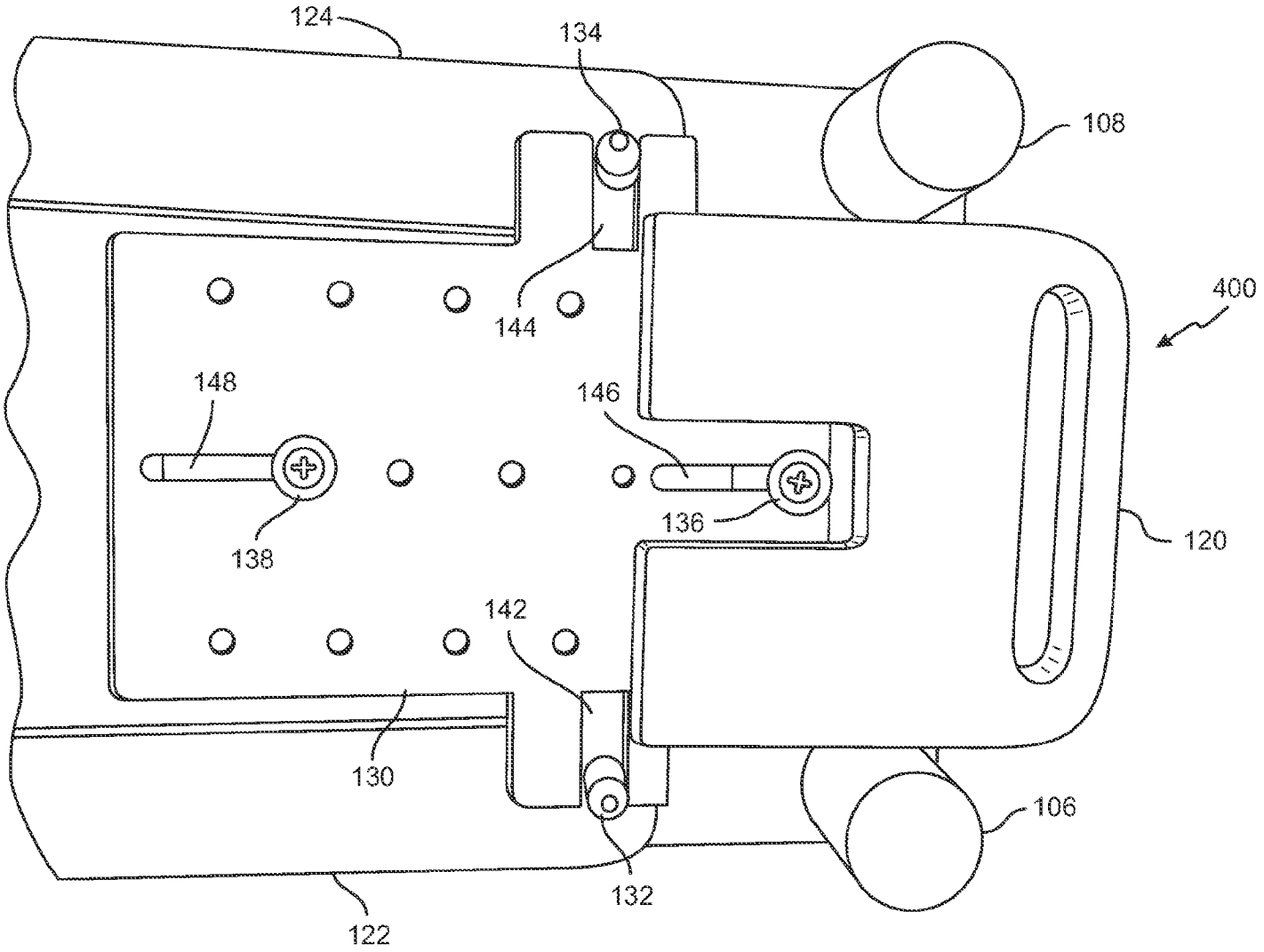
FIG. 8 is a view of the stabilizing mechanism of the book-holding system, in which the stabilizing mechanism is not activated.

Referring to FIG. 8-11, the stabilizing assembly 400 may be seen in more detail. Specifically, the noted figures show the example stabilizing assembly 400 as attached to the underside of the base 100. As shown in FIG. 8 the stabilizing trigger 120 is connected to a plate 130. The plate 130 has two plate slots 146, 148, that enclose guiding rods 136, 138. The guiding rods 136, 138 connect the plate 130 to the stabilizing block 140, which in turn connects to the base 100. The plate 130 also comprises two plate openings 142, 144, which enclose pivots 132, 134. In turn, pivots 132, 134 rotatably connect the stabilizing legs 122, 124 to the base 100.

Figure 9:
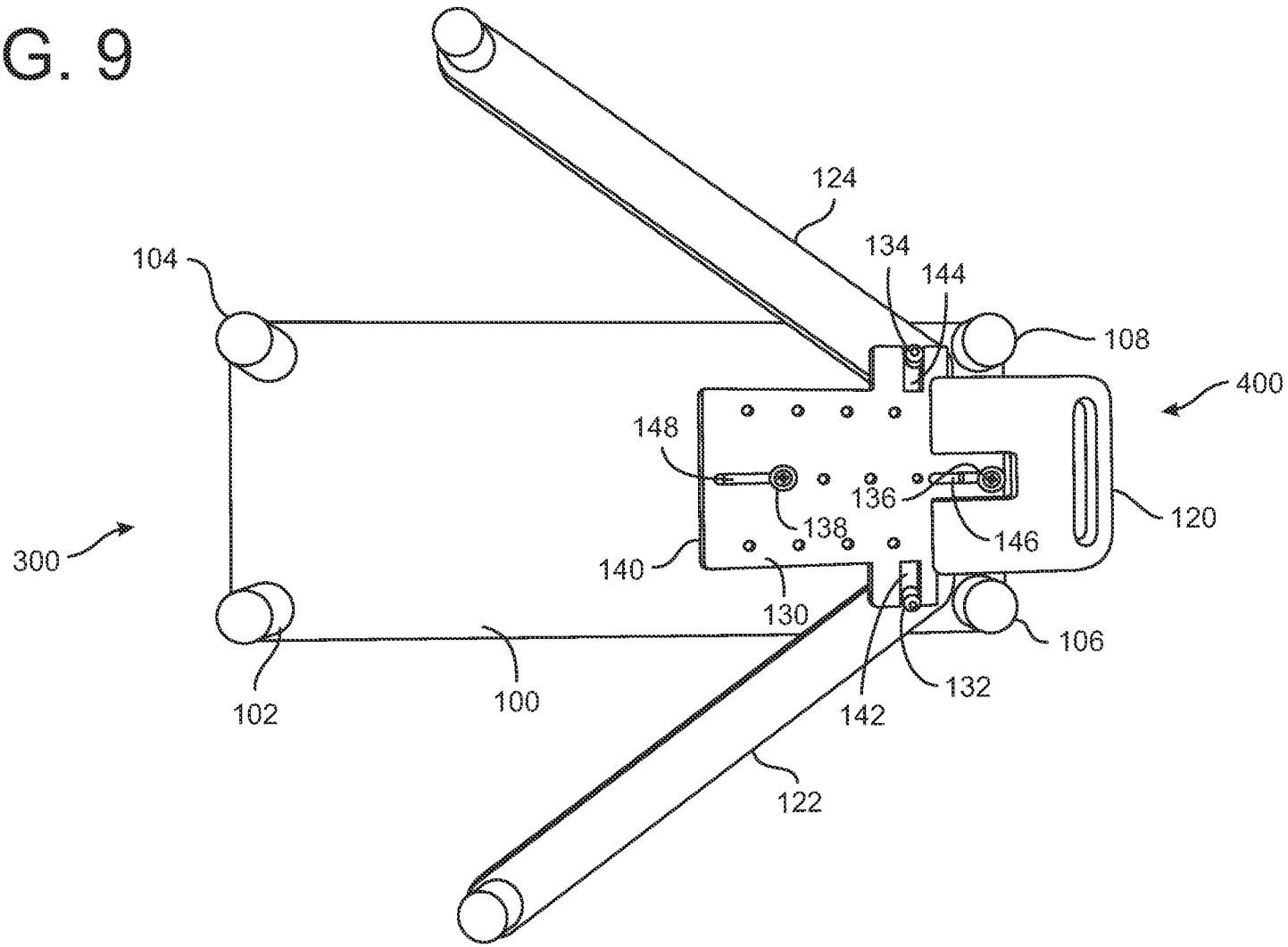
FIG. 9 is a view of the stabilizing mechanism of the book-holding system, in which the stabilizing mechanism is activated

As shown in FIG. 9, when the stabilizing trigger 120 is activated, in this example when the trigger 120 is pulled away from the base 100, the plate 130 slides linearly, away from the center of the base 100, so that the guiding rods 136, 138 slide linearly to the opposite end of the plate slots 146, 148. At the same time, the plate 130 forces the pivots 132, 134, to slide within the openings 142, 144, inward toward and the center of the plate. In doing so, this causes the stabilizing legs 122, 124 extend outward away from the base 100 to provide a broader foundation for the apparatus 300.

Figure 10:
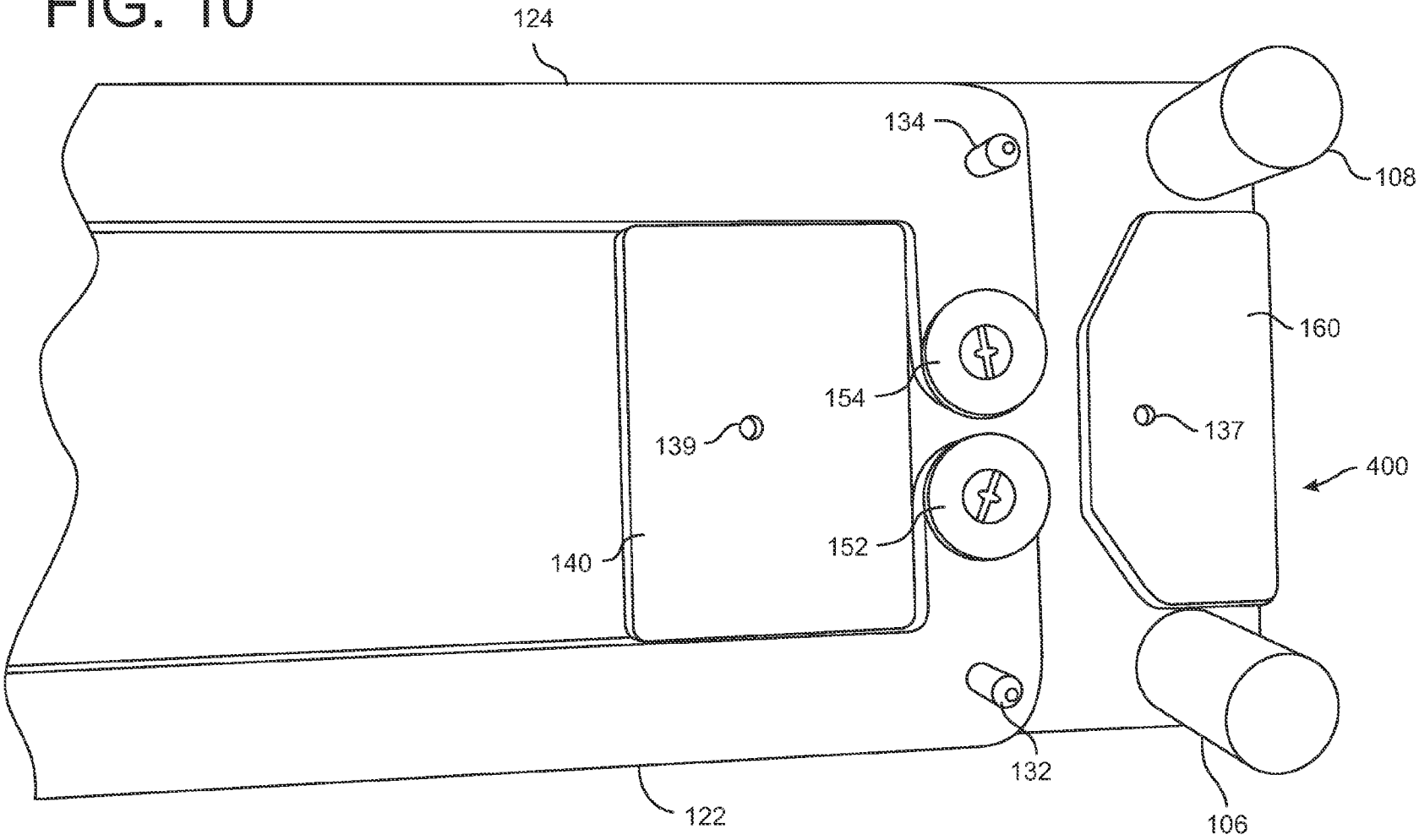
FIG. 10 is a view of the partially-deconstructed stabilizing mechanism of the book-holding system, in which the stabilizing mechanism is not activated.
Figure 11:
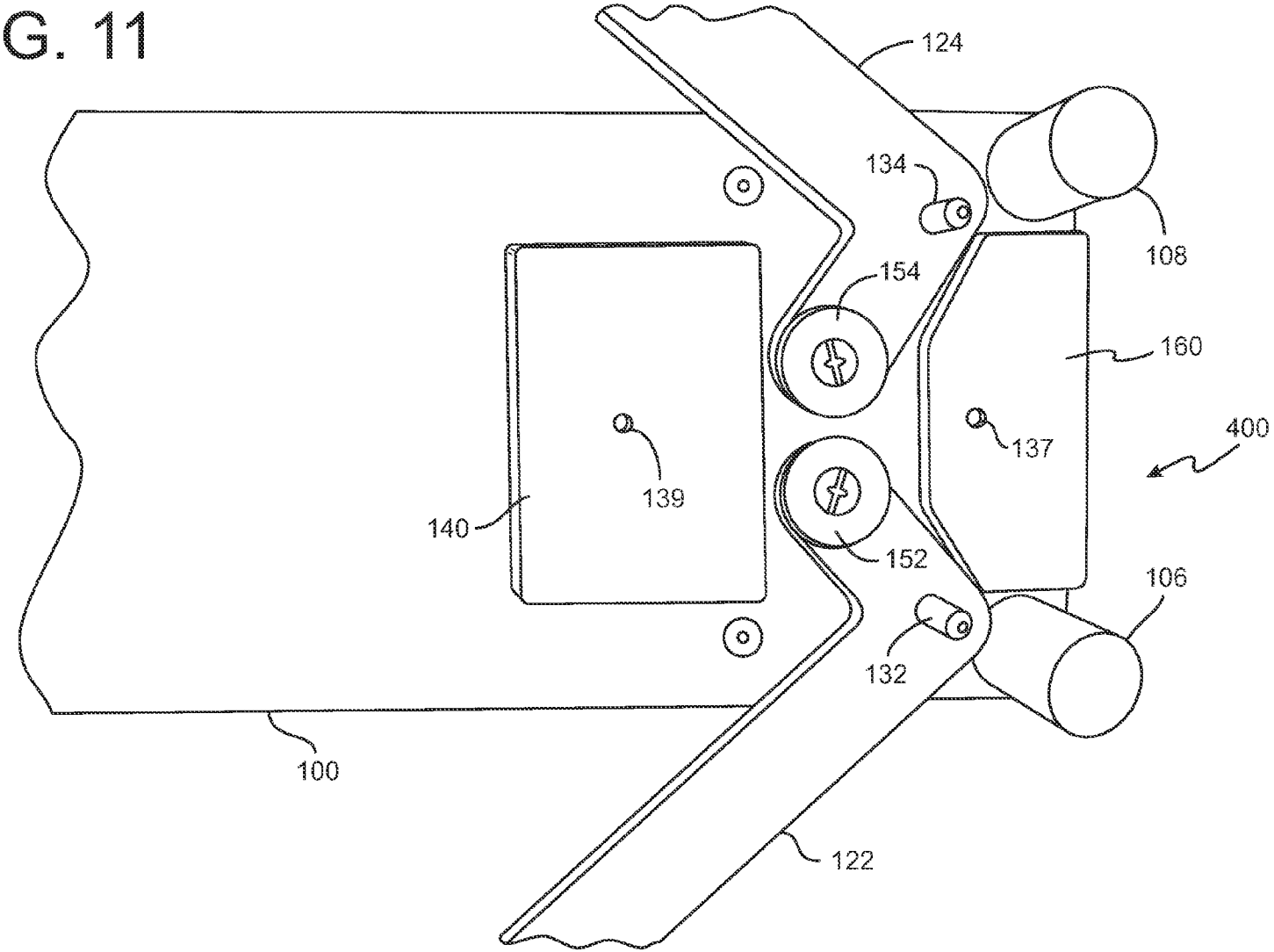
FIG. 11 is a view of the partially-deconstructed stabilizing mechanism of the book-holding system, in which the stabilizing mechanism is activated.

The operation of the example stabilizing assembly 400 is further described in reference to FIGS. 10-11, which show the stabilizing assembly 400 with the plate 130 removed. As shown the screw holes 137, 139 correspond to the guiding rods 136, 138, respectively. In this example, the stabilizing legs are L-shaped, and attach to the base 100 via a pair of rotating pins 152, 154. When the stabilizing assembly 300 is not activated (as shown in FIG. 11) the stabilizing legs 122, 124 are disposed so the short sides of the stabilizing legs 122, 124 are collinear, and the long sides of the stabilizing legs 122, 124 are parallel.

When the stabilizing assembly 300 is activated (as shown in FIG. 11), the stabilizing trigger 120 is pulled outward, and the plate 130 causes the plate pivots 132, 134 to slide upward, and inward within the plate openings 142, 144. This causes the stabilizing legs 122, 124 to rotate around the rotating pins 152, 154 so the long portions of the stabilizing legs122, 124 extend away from the base 100. Thus the long sides of the stabilizing legs 122, 124 are angled outward in a non-parallel orientation and provide a broader base for the book-holding apparatus 300. At the same time, the short sides of the stabilizing legs 122, 124 are angled so that they contact the block 160.

Figure 12:
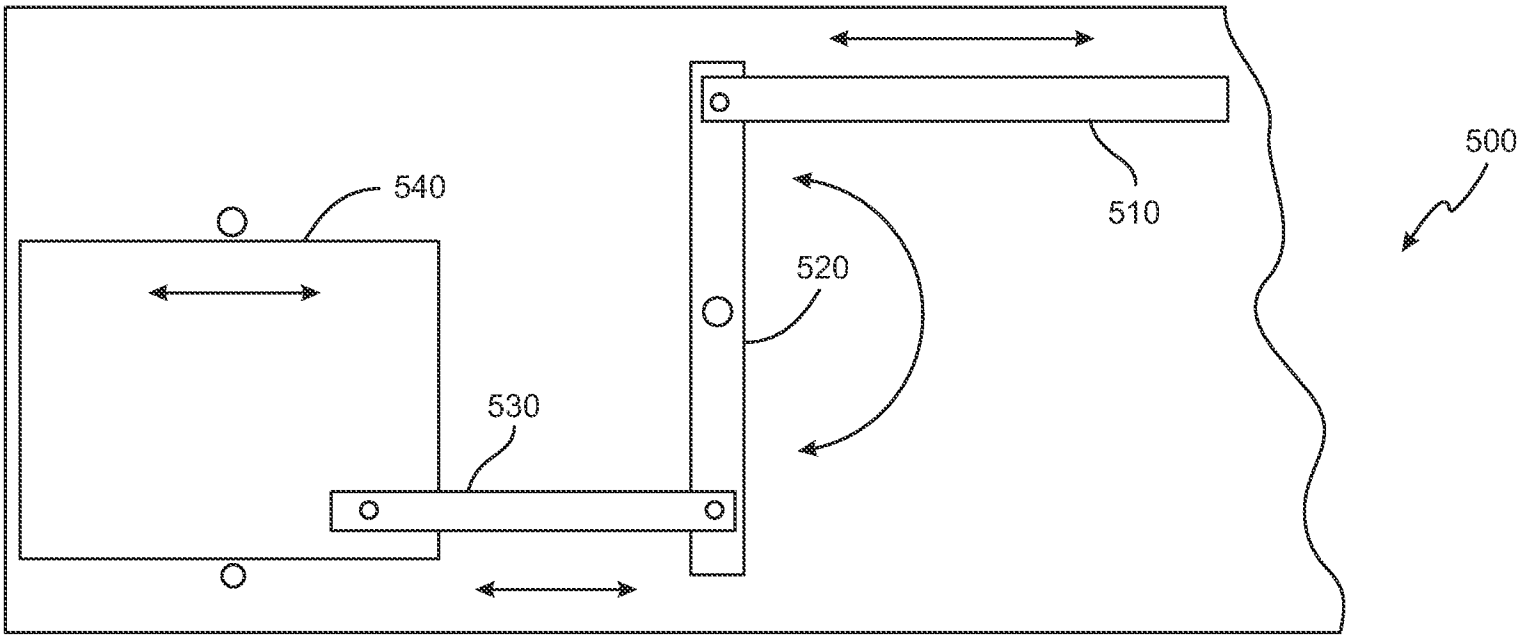
FIG. 12 is a bottom view of another example stabilizing mechanism of the book-holding system.

FIG. 12 illustrates a second stabilizing assembly 500, which may be used in the book-holding apparatus 300 underneath the base 100 in addition to, or instead of the stabilizing assembly 400. In this example system, when a linkage 510 is pushed forward, an element 520 shifts so the element 520 is no longer perpendicular to the linkage 510 and an element 530. This causes the element 530 to move linearly, parallel to the linkage 510. As a result, the outrigger 540 moves linearly outward from underneath the base 100, providing additional structural support to the apparatus 300.

While various concepts have been described in detail, it will be appreciated by one of ordinary skill in the art that various modifications and alternatives to those concepts could be developed in light of the overall teachings of the disclosure. For example, it will be appreciated that the apparatus 300 may be mounted on moveable rollers so that the entire apparatus 300 may slide smoothly across a flat surface. Additionally, the apparatus 300 may be reproduced to create a larger assembly wherein a plurality of book-holding apparatus 300 are placed side-by-side orientation (e.g., in a bookshelf, etc.). In that example, the book-holding apparatus 300 may be mounted on rollers, a gliding mechanism, circular display rack, and/or any other appropriate mechanism. Further, the apparatus 300 may include identifying markings (e.g., title, volume number, date, owner's name, promotional name, etc.) on various locations, including for example, on the book cover, spine element 200, backstop 150, base 100, stabilizing trigger 120, mounting element 204, clamp 110, and/or any other appropriate location. Further still, the apparatus 300 may include bookmarks, and/or placeholders, for example attached to the mating element 204.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A book holding apparatus, comprising:

a base portion having an upper surface defined between a first end of the base portion and a second end of the base portion;

an upright element mounted to the upper surface of the base portion at a first area of the base portion that is located between the first end of the base portion and the second end of the base portion via a hinge, the upright element having an element for releasably attaching the book thereto and being pivotable between an inclined position and an upright position that is perpendicular relative to the upper surface of the first area of the base portion;

a backstop element mounted to the upper surface of the base portion at a second area of the base portion that is located between the upright element and the second end of the base portion, wherein at least one portion of the backstop element is disposed such that when the upright element is disposed in the inclined position, the upright element contacts the at least one portion of the backstop element to maintain the upright element in the inclined position; and a book receiving element mounted to the upper surface of the base portion at a third area of the base portion that is located between the upright element and the first end of the base portion, the book receiving element having a first upstanding surface and a second upstanding surface that is spaced from the first upstanding surface for removeably receiving therebetween the book when the book attached to the upright element is in a closed state and the upright position is in the upright position wherein a distance between the first area of the base portion and the second area of the base portion is shorter than a distance between the third area of the base portion and the first area of the base portion.

2. The book holding apparatus as recited in claim 1, wherein the inclined position is at an angle between 0° and 90° relative to upright position.

3. The book holding apparatus as recited in claim 1, further comprising a stabilizing mechanism which, when activated, provides additional support to the base element and wherein the stabilizing mechanism is activable by a manual trigger.

4. The book holding apparatus as recited in claim 1, further comprising a stabilizing mechanism which, when activated, provides additional support to the base element and wherein the stabilizing mechanism is associated with a bottom surface of the base portion.

5. The book holding apparatus as recited in claim 1, wherein the base portion is mounted onto a plurality of stable, non-movable feet elements.

6. The book holding apparatus as recited in claim 1, wherein the upright element includes hardware for attaching to a spine portion of the book.

7. The book holding apparatus as recited in claim 1, wherein the upright element includes hardware for attaching to a cover portion of the book.

8. The book holding apparatus as recited in claim 1, wherein the upright element further comprises a restraining element for engaging the front cover and the back cover of the book when the upright element is in the inclined position.

9. The book holding apparatus as recited in claim 1, wherein the stabilizing mechanism comprises a plate having a plurality of openings.

10. The book holding apparatus as recited in claim 1, wherein the stabilizing mechanism comprises at least two stabilizing legs that extend outward from beneath the base when the stabilizing mechanism is activated.

11. The book-holding apparatus as recited in claim 10, wherein the at least two stabilizing legs are L-shaped.

12. The book holding apparatus as recited in claim 11, wherein the stabilizing mechanism further comprises a plate having at least one opening, and the at least two stabilizing legs are activated by at least one pin that is in communication with the at least one opening of the plate.

* * * * *